US005432955A

United States Patent [19]

Plotka et al.

[11] Patent Number: 5,432,955

[45] Date of Patent: Jul. 18, 1995

[54] QUICK RELEASE REUSABLE SWEATBAND

[76] Inventors: Artur P. Plotka; Teresa Plotka, both of 9 Roosevelt Ave., Trenton, N.J. 08620

[21] Appl. No.: 247,766

[22] Filed: May 23, 1994

[51] Int. Cl.[6] ..... A42B 1/06

[52] U.S. Cl. ..... 2/181; 2/181.4; 2/209.12

[58] Field of Search ..... 2/181, 181.4, 181.6, 2/209.11, 209.12, 209.13, 918, DIG. 11, 171, 175.1, 195.1

[56] References Cited

U.S. PATENT DOCUMENTS

| | | | |
|---|---|---|---|
| 411,155 | 9/1889 | Lewis . | |
| 429,341 | 6/1890 | Field . | |
| 1,391,902 | 9/1921 | Martin | 2/181 |
| 2,483,101 | 9/1949 | Nelms | 2/181 |
| 4,941,210 | 7/1990 | Konucik | 2/181.4 |
| 5,058,210 | 10/1991 | Tivis | 2/181 |
| 5,088,126 | 2/1992 | Mathis | 2/181 |
| 5,181,277 | 1/1993 | Sherman | 2/209.12 |
| 5,327,585 | 7/1994 | Karlan | 2/181 |

*Primary Examiner*—Clifford D. Crowder
*Assistant Examiner*—Diana L. Biefeld
*Attorney, Agent, or Firm*—Henry S. Miller; David L. Baker; Rhodes & Ascolillo

[57] ABSTRACT

A reusable sweatband for sport caps and athletic headgear including a moisture receiving and retaining means attached to a strip of hook and loop fastener for placement inside the headgear with a corresponding strip of hook and loop fastener. One end of the velcro is stripped of its hooks making the strip easier to grasp and remove. A grommet is placed near the end adapted for grasping in order that the sweatband may be stored for drying or future use.

2 Claims, 2 Drawing Sheets

FIG. 1
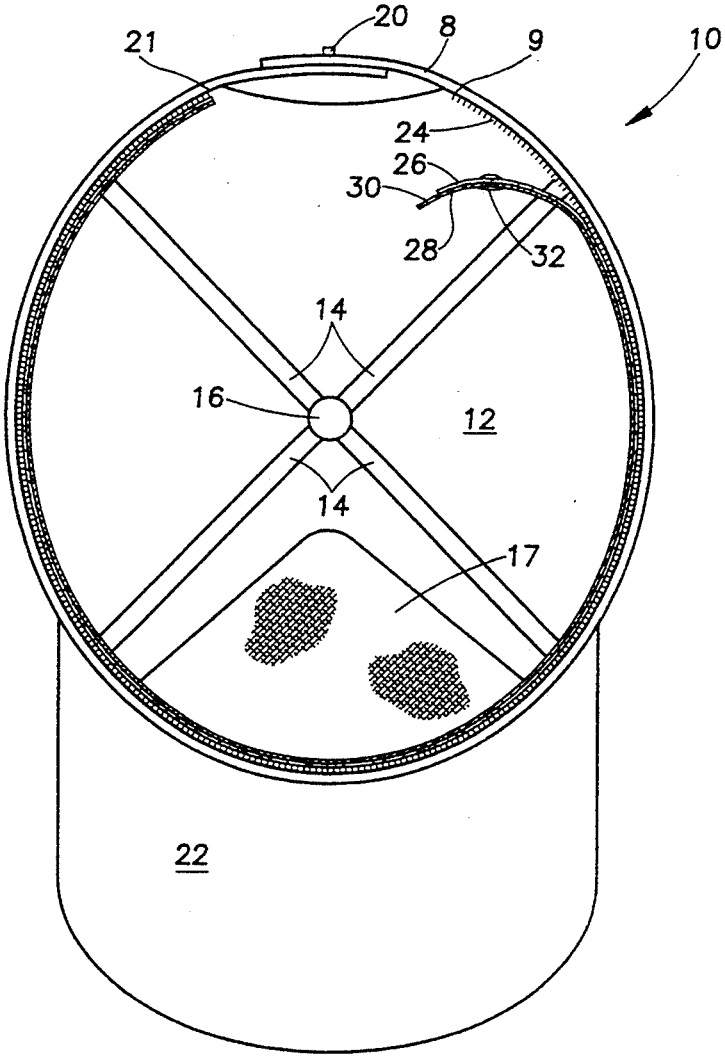
FIG. 4
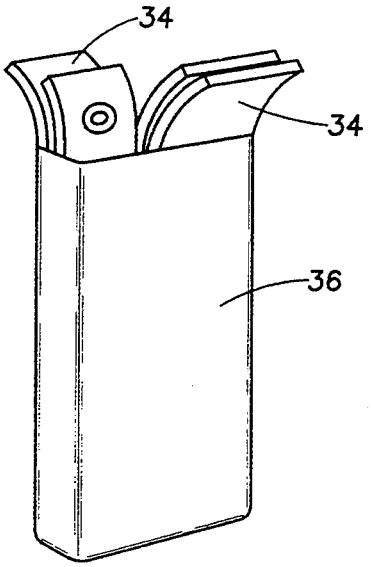
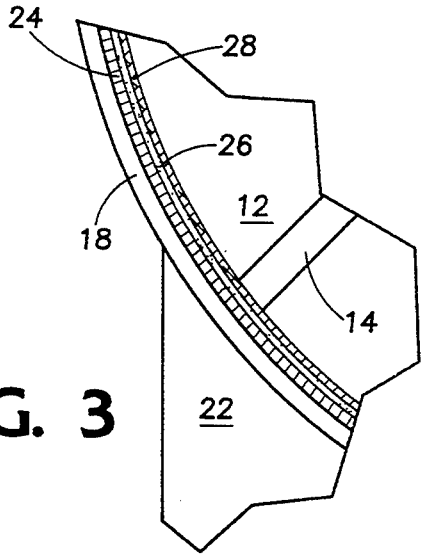
FIG. 3

QUICK RELEASE REUSABLE SWEATBAND

BACKGROUND OF THE INVENTION

1. Field of the Invention

This invention relates generally to sports wear and more particularly to sweat bands for athletic and sports headgear.

2. Description of the Prior Art

Nearly all outdoor sport uniforms include some form of headgear, generally to protect the players from the heat and the glare of the sun. Some sports have headgear to protect the athletes from injury, but all sports have a common problem of perspiration from the scalp and forehead finding its way into the players eyes and causing blurred vision and irritation. During the competition it is not always convenient for the player to remove his headgear and dry his head with a towel. In addition, conventional sweatbands currently used in athletic and sports headgear quickly become saturated and simply slow the flow of perspiration without really stopping it.

The same holds true for the very popular sports cap worn by non athletes but those who wear the cap and logo to show their support for their favorite team. It really makes no difference whether the wearer is in the stands on a hot day watching the sporting event or in the playground having disorganized fun, the problem is the same.

As head gear changed over the years so did the approach to controlling the perspiration problem,for example in the time when all gentlemen wore hats, U.S. Pat. No. 411,155 issued Sep. 17, 1889 to F. W. Lewis and U.S. Pat. No. 429,341 issued Jun. 30, 1890 to P. I. Field show a band and liner for a formal hat of the era. In more current times the sweat band has been associated with hard hats worn in mines, on the oil fields and construction projects. U.S. Pat. No. 2,483,101 issued Sep. 27, 1949 to Nelms; U.S. Pat. No. 5,058,210 issued Oct. 22,1991 to Tivis, and U.S. Pat. No. 5,088,126 issued Feb. 18, 1992 to Mathis all show and describe sweatbands for hard hats that are disposable and not reusable, contrary to the intent and purpose of this invention.

SUMMARY OF THE INVENTION

The invention is a removable sweatband for caps and athletic equipment that is easy to install, quick to remove and washable. Accordingly these are some of the objects of the invention.

The headgear used with the invention would have a band of loop material fixed to the interior where a sweat band would normally be located. The band of the invention would be a strip of moisture receiving and retaining material backed by a strip of hook and loop fastener material commonly known as Velcro TM.

The invention is distinguished from a simple sweatband secured with a hook and loop fastener by two features not seen in the prior art. In one feature the hook and loop fastener does not extend to the end of the strip but just short of the end thereby making it easy to grasp the strip between the thumb and forefinger and separating the hook and loop combination. The second feature is the grommet installed near the space for grasping the strip. Since this invention is conceptualized of the notion that the sweatbands will be washed and reused, then it follows that there must be a way to conveniently hang them for drying. That not only applies to the post laundry dry but also the case of the intra contest replacement drying. That is, when the athlete returns to the dugout or bench and wishes to change sweat bands, rather then throw the band on the bench or ground he merely hangs the band on a hook provided and takes a dry band from another hook provided. After the contest the equipment manager collects the bands has them laundered and they are ready for the next contest or practice.

It is anticipated that the sweatbands would be marketed in packages of five for the non athletes who take pride in the new look of their cap and prefer to avoid and delay laundering the entire cap.

It is therefore an object of the invention to provide a new and improved quick release, reusable sweatband.

It is another object of the invention to provide a new and improved quick release, reusable sweatband for sports caps and athletic equipment.

It is a further object of the invention to provide a new and improved reusable sweatband that is easy to remove.

It is still another object of the invention to provide a new and improved reusable sweatband that is low in cost.

It is still a further object of the invention to provide a new and improved quick release, reusable sweatband for sports caps and athletic equipment that may be easily and efficiently manufactured and marketed.

These and other advantages, features and objects of the invention will become more apparent from the following description taken in connection with the illustrative embodiment in the accompanying drawings.

DESCRIPTION OF THE DRAWINGS

FIG. 1 is a bottom plan view of a sport cap showing a sweatband removed in part.

FIG. 3 is a segment of a plan view of the invention showing the alignment of the strips of the headband.

FIG. 4 is a perspective view of a package of headbands.

DESCRIPTION OF THE PREFERRED EMBODIMENT

Figure 2:
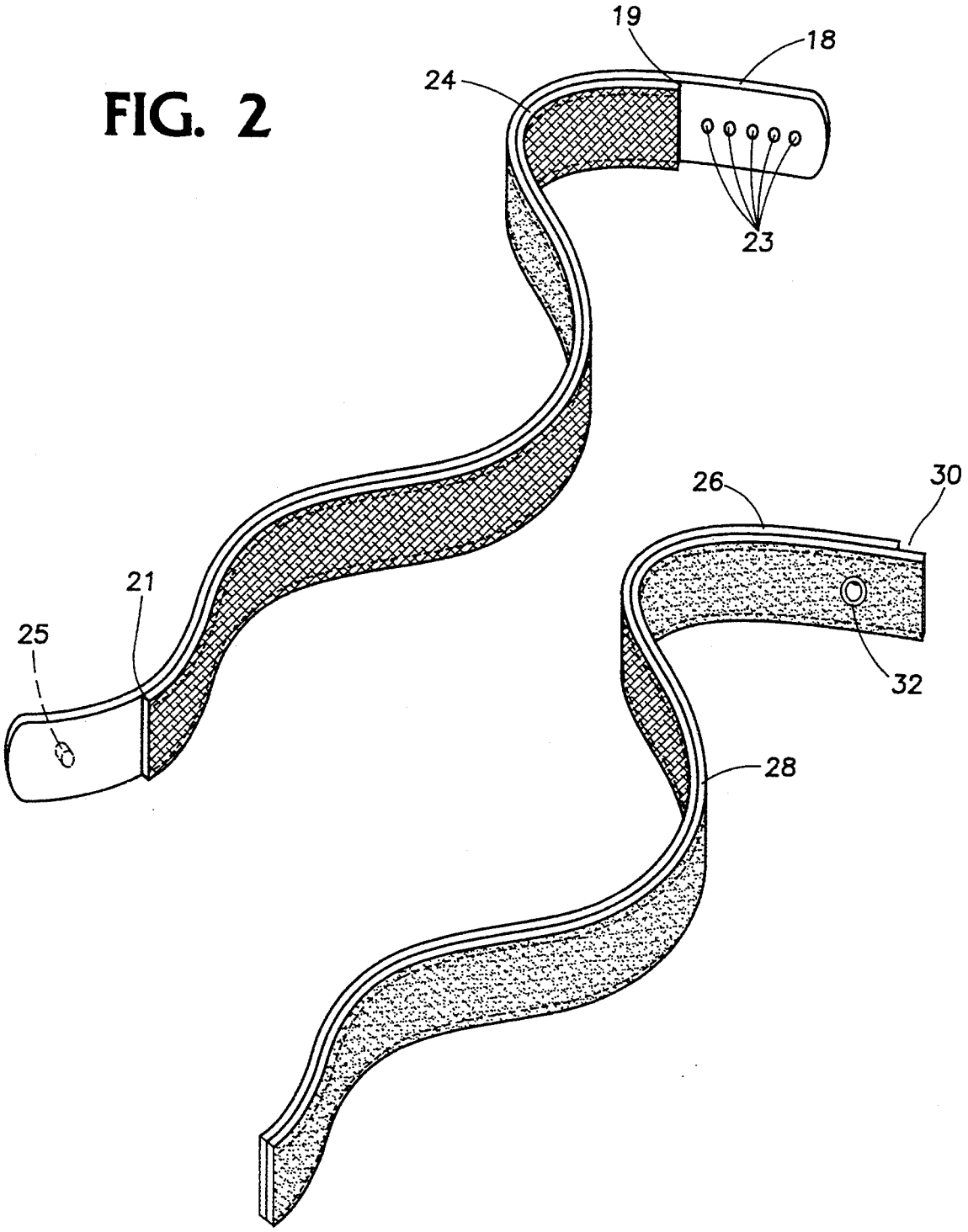
FIG. 2 is a perspective view of the sweat band and the corresponding cap liner.

Referring now to FIG. 1 the interior of a sports cap is shown generally at 10. The panels forming the cap are shown as 12 and seams joining the panels at 14. The button forming the crown of the cap is 16. Panel 17 is a semi rigid material that gives shape to the cap and provides a backing for the logo usually sewn or embroidered on the front above the visor. The typical cap has a heavy plastic headband 18 that is adjustable in the back using a row of holes, not shown, and a post 20 passing through one hole making the correct fit. The front of the cap is provided with a visor 22 to assist in reducing glare from the sun.

A strip of loop material 24 is bonded to headband 18 from point 19 to point 21 thereby not including the adjustable portion headband 18. A strip of hook material 26 is affixed to moisture receiving and retaining material 28 removably connecting it to the headband. The end of strip 28 is devoid of hooks as shown at 30, thereby allowing for a quick and easy grasp of the strip, even by wet hands, for removal. Grommet 32 allows the sweat band,when not in use, to be hung in a convenient location.

FIG. 2 shows the heavy plastic headband 18 with adjustment holes 23 and post 25. The strip of loop material 24 begins at point 19 and ends at 21. The corresponding strip of hook material is shown at 26 with a moisture absorbent material, such as cotton for example, 28 fixed thereto, as by sewing or other practical well known methods of attachment. Grommet 32 is shown in proximity to the area devoid of hooks 30, that is used for grasping the strip.

FIG. 3 discloses the relative locations of the strip material in place. The moisture receiving and retaining material 28, abuts the wearers scalp. Next is hook material 26 engaged with loop material 24, fixed to headband 18.

In FIG. 4 there is shown a number of sweat bands 34 in a convenient package 36 that may be carried in a purse, gym bag or jacket pocket.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. In a sports cap having an adjustable annular headband including male and female adjustment means, a soft head covering, a visor attached externally to the head covering and a semi-rigid material attached to the interior of the cap contiguous with the visor to shape the cap, the improvement which comprises:

a) a strip of loop material of a hook and loop fastener attached to the headband beginning at one end proximate the male adjustment means and following the headband to the other end proximate the female adjustment means;

b) sweatband further comprising:

a strip of moisture receiving and retaining material;

a strip of hook material of said hook and loop fastener attached to the strip of moisture receiving and retaining material and adapted to removably engage the strip of loop material of said hook and loop fastener material, whereby the moisture receiving and retaining material is in juxtaposition with the scalp of the wearer;

an area at one end of the strip of hook material adapted to be grasped for separating the said strip of moisture receiving and retaining material from the strip of loop material; and c) a means for allowing the storage of sweatbands further comprising a grommet located in the sweatband proximate one end.

2. A sports cap according to claim 1 wherein the grommet is located at the end proximate the area adapted to be grasped.

* * * * *